United States Patent [19]

Yuyama et al.

[11] Patent Number: 4,619,889

[45] Date of Patent: Oct. 28, 1986

[54] IMAGE FORMING METHOD

[75] Inventors: Hideo Yuyama; Motohiko Tsubota, both of Kanagawa, Japan

[73] Assignee: Fuji Photo Film Co., Ltd., Kanagawa, Japan

[21] Appl. No.: 573,455

[22] Filed: Jan. 24, 1984

[30] Foreign Application Priority Data

Jan. 24, 1983 [JP] Japan ..... 58-10421

[51] Int. Cl.[4] ..... G03C 5/24

[52] U.S. Cl. ..... 430/406; 430/235; 430/236; 430/244; 430/246; 430/494

[58] Field of Search ..... 430/494, 396, 406, 235, 430/236, 244, 246

[56] References Cited

U.S. PATENT DOCUMENTS

| | | | |
|---|---|---|---|
| 3,642,477 | 2/1972 | Trusheim et al. | 430/396 |
| 3,709,689 | 1/1973 | Florens et al. | 430/494 |
| 3,868,256 | 2/1975 | Sato et al. | 430/567 |
| 3,935,010 | 1/1976 | Gilman | 430/494 |
| 4,207,103 | 6/1980 | Gilman et al. | 430/494 |
| 4,327,172 | 4/1982 | Martin et al. | 430/406 |
| 4,395,478 | 7/1983 | Hoyen | 430/378 |
| 4,431,730 | 2/1984 | Urabe et al. | 430/564 |
| 4,478,928 | 10/1984 | Hess et al. | 430/598 |

*Primary Examiner*—Mary F. Downey

*Attorney, Agent, or Firm*—Sughrue, Mion, Zinn, Macpeak, and Seas

[57] ABSTRACT

An image forming method which comprises copying an original on a photosensitive material employing a direct reversal photographic emulsion is disclosed. The method comprises conducting ordinary exposure when the original image is a positive image and conducting exposure at high illuminance when the original image is a negative image. Thereby, it is possible to obtain a direct positive image from either the original positive or original negative image. The process is greatly advantageous with respect to forming positive images since the process can be utilized to obtain positive images regardless whether the original image is positive or negative.

2 Claims, 4 Drawing Figures

IMAGE FORMING METHOD

FIELD OF THE INVENTION

This invention relates to an image forming method, and more specifically, it relates to an image forming method which comprises obtaining a positive image by providing an exposure which will form a negative image to a photographic material employing the so-called direct reversal photographic emulsion.

BACKGROUND OF THE INVENTION

Image forming methods for obtaining a positive image for viewing include the methods described below.

(1) Negative - Positive Method

This is a method which comprises forming a negative image on a photosensitive material which is an intermediate medium by shooting etc., and thereafter forming a positive image on another photographic material from said negative image. Accordingly, this is a method of conducting negative type development of the negative photographic emulsion twice.

(2) Direct Positive Method

This is a method which comprises directly forming a positive image on a final photographic material by shooting etc. without passing through an intermediate medium, and more specifically, this may further be classified into the following two types:

(a) that by the reversal development of a negative photographic emulsion; and (b) that employing a direct reversal photographic emulsion.

Therefore, where it is contemplated to obtain the so-called photographic prints having positive images from both medium having a negative image (e.g. a color negative film) and medium having a positive image (e.g. a color slide film), then in the former caes of the color negative film, it is necessary to conduct printing on a color photographic paper employing a negative photographic emulsion and then conduct negative type development, while in the latter case of the color slide film, it is necessary to conduct reversal development of a color photographic paper employing a negative photographic emulsion or to employ a color photographic paper employing a direct reversal photographic emulsion. In short, the kind of the photographic materials for prints and the processing methods are completely different depending on whether the image possessed by the original medium is a negative image or a positive image.

The situation described above has heretofore been accepted as a matter of course by those engaged in the photography processing industry; however, in fact, it is extremely troublesome and very inefficient to change the photographic material and the processing method depending on the kind of the image possessed by the original medium (hereinafter referred to as "the original image"), that is, whether it is a positive image or a negative image.

SUMMARY OF THE INVENTION

A primary object of the present invention is to provide an image forming method which makes it possible to obtain a photographic print having a positive image merely by adding a simple operation while using the same photographic material regardless of the kind of original image.

The invention resides in either conducting ordinary exposure when the original image is a positive film or conducting exposure at high illuminance when the original image is a negative image on a photographic material employing a direct reversal photographic emulsion, thereby making it possible to obtain a photographic print having a direct positive image from either original image.

DETAILED DESCRIPTION OF THE INVENTION

Figure 3:
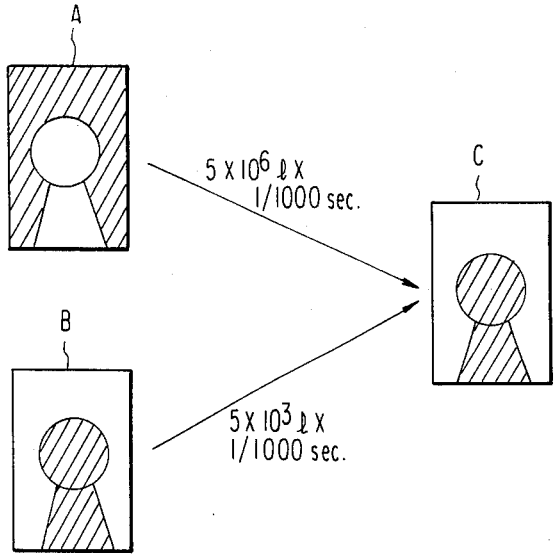
FIG. 3 is a schematic figure showing one embodiment of the present invention.

The direct reversal photographic emulsion employed in this invention may be a conventional material, especially, unfogged type material. Useful direct reversal photographic emulsions of the unfogged type include a photographic emulsion which can provide a direct reversal image by fogging on development. For example, it is possible to carry out fogging by exposure to light again during the developing process after exposure or by conducting development in the presence of a nucleating agent (fogging agent), and so forth. Recently, with the propagation of so-called instant photography, the photographic materials used in this field enjoy a wide range of uses.

The emulsion used may be an internal latent image type emulsion. Examples of the internal latent type silver halide emulsions include, a conversion emulsion which made use of a catastrophe precipitation method which comprises forming grains of a silver salt such as silver chloride having high solubility and subsequently converting it into a less soluble silver salt such as silver (iodo)bromide etc. (U.S. Pat. No. 2,592,250), a core-shell emulsion obtained by mixing a core emulsion of chemically sensitized large grains with an emulsion of minute grains and aging the mixture, thereby forming silver halide shells around the core grains (U.S. Pat. No. 3,206,313 and British Pat. No. 1,011,062), a core-shell emulsion obtained by simultaneously adding a soluble silver salt solution and a soluble halide solution to a chemically sensitized core emulsion in a single dispersion form while maintaining the silver ion concentration constant, thereby forming silver halide shells on the core grains (British Pat. No. 1,027,146 and U.S. Pat. No. 3,761,276), a halogen localized emulsion in which emulsion grains are of a laminate structure of two or more and the halogen composition is different between the first phase and the second phase (U.S. Pat. No. 3,935,014) as well as those prepared according to the methods described in E. J. Wall, Photographic Emulsions, p. 35–36 and 52–53, American Photographic Publishing Co., 1929, U.S. Pat. Nos. 2,497,875, 2,563,785, 3,511,662, etc.

A preferable example of the direct reversal photographic emulsion used in the present invention is described, for example, in U.S. Pat. No. 4,332,885 including Emulsions 1, 2 and 3 and U.S. Pat. No. 4,431,731. Emulsion 1 is, for instance, produced by adding a silver nitrate aqueous solution and a potassium bromide aqueous solution by a controlled double jet process to a chemically aged core emulsion which is chemically aged reaction mixture of silver nitrate aqueous solution, potassium bromide aqueous solution and gelatin aqueous solution by a controlled double jet process.

Representative examples of the nucleating agent for the emulsion of this type include hydrazines described in U.S. Pat. Nos. 2,588,982 and 2,563,785; hydrazides and hydrazones described in U.S. Pat. No. 3,227,552; quaternary salt compounds described in British Pat. No. 1,283,835, Japanese Patent Publication No. 38164/1974, U.S. Pat. Nos. 3,615,615, 3,719,494, 3,734,738, 4,094,683, 4,115,122, etc.; sensitizing dyes containing a nucleating substituent in the dye molecule described in U.S. Pat. No. 3,718,470; and acylhydrazinophenylthiourea type compounds described in U.S. Pat. Nos. 4,030,925 and 4,031,127. In addition, the compounds described in, for example, U.S. Pat. No. 4,139,387, Japanese Patent Publication Nos. 133126/1979 and 74729/1979 may also be employed.

The nucleating agent is preferably employed in such amount that when a internal latent image type emulsion is developed using a surface developing solution, an adequate maximum density is imparted. Although the actual amount can vary over a wide range because it varies depending on the characteristics of the silver halide emulsion employed, the chemical structure of the fogging agent and the developing conditions, it is suitably about 0.01–5 g, preferably 0.05–1 g, per liter of the developing solution where the fogging agent is incorporated in the developing solution. Where it is added to the emulsion layer, a range of about 0.1 mg–5 g per mole of silver in the internal latent image type silver halide emulsion is practically useful, and a preferred amout is about 0.5 mg to about 2 g per mole of silver. Where it is contained in a hydrophilic collide layer adjacent to the emulsion layer, it is satisfactory to incorporate an amount similar to the above based on silver contained in the same surface area of the internal latent image type emulsion.

The silver halide emulsion employed in this invention also can have color sensitivity enhanced by a spectrally sensitizing dye if desired. Useful spectrally sensitizing dyes include cyanine dyes, merocyanine dyes, etc. The term "High illuminance" means any illuminance level sufficient to obtain a positive image from a nagative original, using a photosensitive material having a direct reversal photographic emulsion layer. For instance, illuminance level of $1.5\times10^6$ lux or more is preferably employed.

Figure 1:
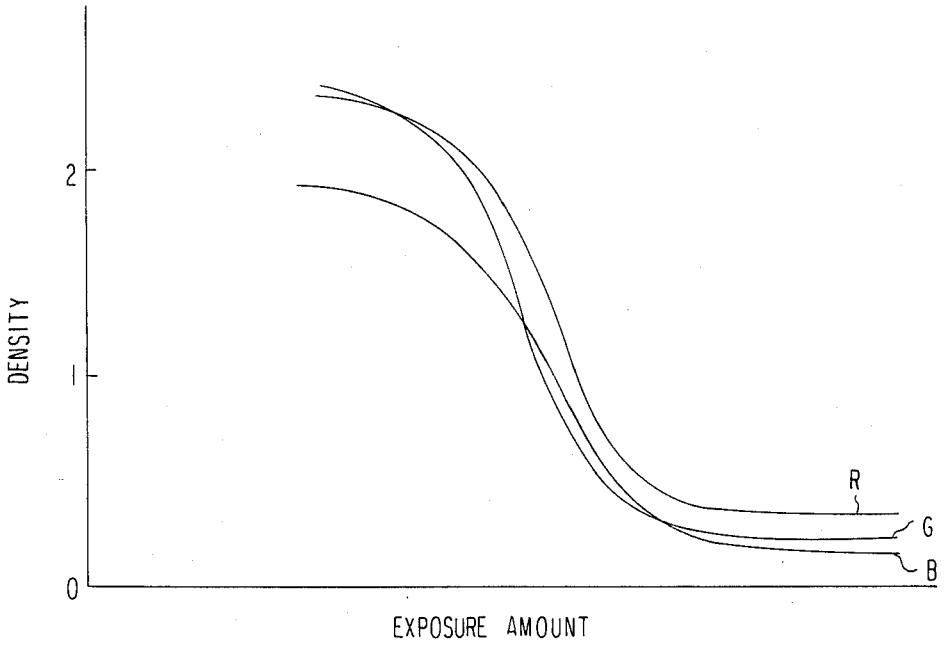
FIG. 1 is a graph showing characteristic curves under ordinary exposure conditions.
Figure 2:
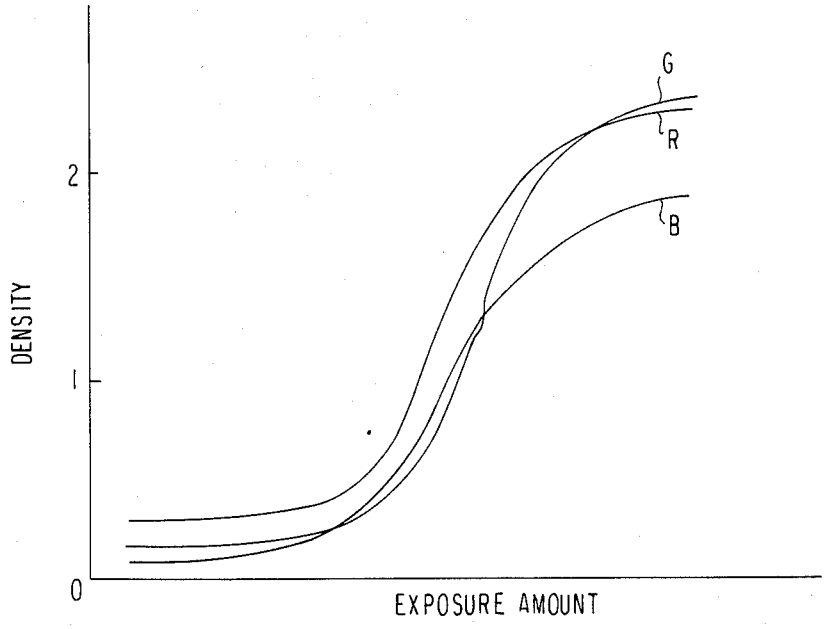
FIG. 2 is the graph showing characteristic curves when exposure at high illuminance is conducted.

Exposure amount and illuminance level used in the present invention are determined in such amount that when a positive image is expected from an original positive image, a positive image is obtained forming a curve similar to the curve represented by FIG. 1 and when a positive images is expected from an original negative image, a positive image is obtained forming a curve similar to the curve represented by FIG. 2. Exposure amount is preferably 1.5 to $1.5\times10$ (lux·sec) when a positive image is expected from an original positive image, and exposure amount is preferably $1.5\times10^3$ to $1.5\times10^4$ (lux·sec) and illuminance level is $1.5\times10^6$ lux or more, more preferably $3.0\times10^3$ to $1.0\times10^4$ (lux·sec) and $1.5\times10^6$ lux or more when a positive image is expected from an original negative image, in case of the photosensitive material of Examples.

An example of this invention is described in detail with reference to the drawing. However, the scope of the invention is not limited to the example, reference to the drawing.

FIG. 1 and FIG. 2 show photographic characteristics obtained when employing the so-called self-developing photographic film unit "Fuji Instant Color Film FI-10" (produced by Fuji Photo Film Co., Ltd. FI-10 (Fuji instant color film) comprises an integrat imaging receiver comprising a base of polyester support, an image receiving layer, a light reflective layer containing titanium dioxide, a light shielding layer, dye layers which independently release cyan, magenta and yellow dyes, interlayers, color sensitive layers incorporating the direct positive reversal emulsions of the unfogged latent image type and an UV-absorbing layer; a processing fluid; and a cover sheet comprising timing layers, a neutralizing layer, a base of polyester support and a backing layer as an example of the color photographic photosensitive material employing a direct reversal photographic emulsion and conducting exposure at different levels of illuminance. The exposure time was 1/1000 second in both cases, and the illuminance levels were about $5\times10^3$ lux in the case of FIG. 1 and about $5\times10^6$ lux in the case of FIG. 2. On exposure, a non-staged optical wedge was inserted.

With an illuminance level of about $5\times10^3$ lux (FIG. 1), as also clear from the figure, there has been formed a positive image suitable for viewing by the naked eye in the region of the exposure employed. Also, with an illuminance level of about $5\times10^6$ lux (FIG. 2), there has been formed a negative image suitable for viewing by the naked eye in the region of the exposure employed. In FIG. 1 and FIG. 2, the legends R, G and B stand for characteristic curves of a red-sensitive (cyan color developed) layer, a green-sensitive (magenta color developed) layer and a blue-sensitive layer (yellow color developed) layer, respectively.

FIG. 3 is a figure illustrating an image forming system applying the image forming method of the present example as described above. In the figure, A is an original of a negative image, B is an original of a positive image, and C is a photographic print of a positive image. In this example, where it is contemplated to obtain the positive photographic print C from the original of a negative image A, exposure is conducted under exposure conditions of e.g. $5\times10^6$ lx and 1/1000 sec., and where it is contemplated to obtain the positive photographic print C from the original of a positive image B, exposure is conducted under exposure conditions of e.g. $5\times10^3$ lx and 1/1000 sec. The instant film after exposure is developed and processed by a build-in processing agent to give the photographic print C.

Figure 4:
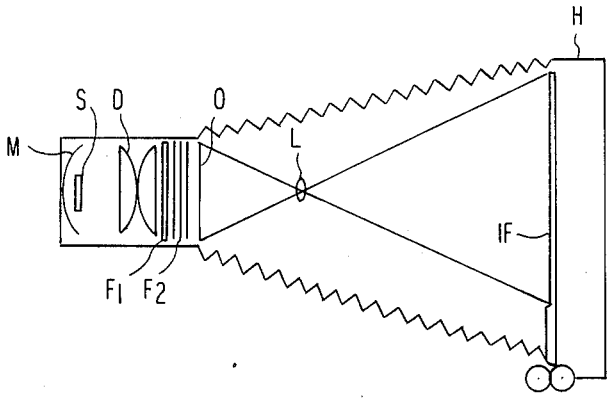
FIG. 4 shows an embodiment of a device for copying to form a positive image in accordance with the present invention.

FIG. 4 is a side cross-sectional view showing a copying device applicable to the above-described example. In this example, S is a stroboscopic light source equipped with a reflecting mirror M; D is a diffuser; $F_1$ is a neutral density filter for adjusting illuminance; $F_2$ is a color correcting filter constructed so as to contain a plurality of filters; O is an original film; L is a lens and IF is the instant film contained in a film holder H. The stroboscopic light source S is, for example, that showing illuminance of $5\times10^6$ lx on the surface of the instant film IF and of an emission period of 1/1000 sec., and operated by a switch not shown in the figure. The diffuser D and the reflecting mirror M share an action to uniformize the light emitted from said stroboscopic light source S on the surface of the original film. The neutral density filter $F_1$ is, for example, a filter of a density of 3, which is not employed when the original film O is a negative film but is employed when the original film O is a positive film. The film holder H containing the instant film IF is equipped with a pair of nip rollers for removing the instant film IF and developing a processing solution. The entire device of this example is constructed optically tight.

Where a positive film is copied, the positive film, the aforesaid neutral density filter $F_1$, the instant film IF and the previously studied color correcting filter $F_2$ are set, and the stroboscopic light source S is emitted. The image on the positive film O illuminated by this is projected and an image is formed on the aforesaid instant film IF through the lens L, thereby exposure is conducted. After exposure, the instant film IF is removed by the aforesaid pair of nip rollers, which are driven by a driving means not shown in the figure, and at the same time the processing solution is develped to start processing.

Further, where a negative film is to be copied, the negative film, the instant film IF and the previously studied color correcting filter $F_2$ are set and the stroboscopic light source S is emitted. The processing stages after the projection of the image on the negative film onto the instant film IF are conducted similarly as above.

Although the emitting time of the stroboscopic light source, that is, the exposure time, employed in the above-described example was 1/1000 sec., the exposure time may be up to about 1/100 sec. Also, the illuminance on the instant film surface may be, for example, about $1.5\times10^6$ lux although about $5\times10^6$ lux was employed in the example. In general, where the exposure time is short and the illuminance is high, it is possible to make the direct reversal photographic emulsion behave as shown in FIG. 2 by a less exposure (Illuminance$\times$Exposure Time). The same procedures as the above described examples were conducted using the Emulsion 1 described in U.S. Pat. No. 4,332,885, and positive images were obtained regardless of the kind of original images.

In the above-described examples, the neutral density filter was employed for adjusting the illuminance, but another method, for example, that of preparing a separate stroboscopic light source, etc. is possible, and such modifications may also be made with the other constituting means.

As have been described above, this invention has made it possible to obtain a photographic print having a direct positive image regardless of the kind of original image. Especially, where this is combined with so-called instant photography, it exerts a remarkable effect in that color print preparation from color negative films which is largely employed in this country may be achieved very simply in a shortened time.

While the invention has been described in detail and with reference to specific embodiments thereof, it will be apparent to one skilled in the art that various changes and modifications can be made therein without departing from the spirit and the scope thereof.

What is claimed is:

1. An image forming method which comprises copying an original image on a photosensitive material employing a direct reversal photographic emulsion, comprising:

conducting ordinary exposure when the original image is a positive image and conducting exposure at high illuminance when the original is a negative image, thereby obtaining a direct positive image from either original image;

wherein the direct reversal photographic emulsion employed in the photographic material is an unfogged internal latent image type emulsion;

and wherein the exposure time at high illuminance is 1/100 sec or less.

2. An image forming method as claimed in claim 1, wherein the photosensitive material employing the direct reversal photographic emulsion is a self-developing type photographic film.

* * * * *